United States Patent [19]

Maire et al.

[11] 4,422,776

[45] Dec. 27, 1983

[54] DEVICE FOR CORRECTION OF TIME DATE DISPLAYED BY AN ELECTRONIC WATCH

[75] Inventors: Aurele Maire, La Chaux-de-Fonds; Norbert Perucchi, St-Blaise, both of Switzerland

[73] Assignee: Compagnie des Montres Longines, Francillon S.A., St-Imier, Switzerland

[21] Appl. No.: 344,646

[22] Filed: Feb. 1, 1982

[30] Foreign Application Priority Data

Feb. 23, 1981 [CH] Switzerland ..... 1173/81

[51] Int. Cl.[3] ..... G04B 27/02

[52] U.S. Cl. ..... 368/185; 368/320; 368/321; 368/190

[58] Field of Search ..... 368/69, 70, 319–321, 368/76, 80, 88, 155, 157, 160, 220, 185, 187, 190, 72, 73, 74, 250, 249, 251, 259, 260

[56] References Cited

U.S. PATENT DOCUMENTS 4,358,837 11/1982 Yamazaki et al. ..... 368/187

*Primary Examiner*—Bernard Roskoski

*Attorney, Agent, or Firm*—Peter L. Berger

[57] ABSTRACT

The correction device of the invention makes it possible to activate, in the same axial position of the crown, two different modes of correction of the data displayed by the watch, it being possible to make those corrections in both directions, depending on the direction of rotation of the crown.

The second correction mode is activated only after a reversal of direction of the correction made according to the first mode.

This device contains, notably, memory means 11, 12, associated with each direction of rotation of the crown, and selection means 21, 31, 22, 32, for choosing the mode and the direction of correction activated in accordance with the direction of rotation of the crown, on the one hand, and a possible reversal of that direction, on the other.

5 Claims, 1 Drawing Figure

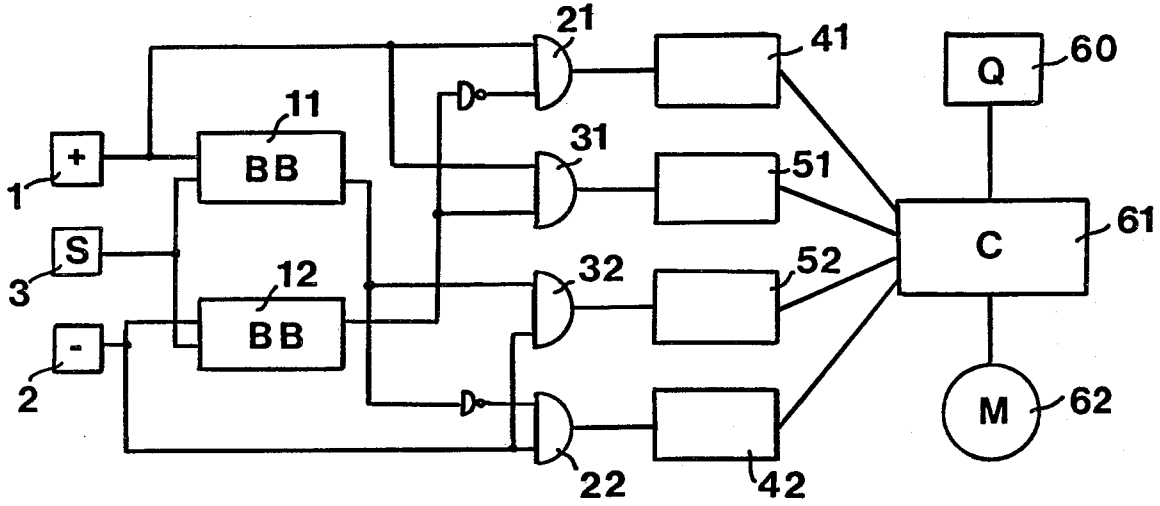
60
Q
61
C
62
M
41
51
52
42
21
31
32
22
11
BB
12
BB
+
1
S
3
-
2

DEVICE FOR CORRECTION OF TIME DATE DISPLAYED BY AN ELECTRONIC WATCH

This invention concerns devices for correction of time data displayed by an electronic watch, and it relates more specifically to electronic watches in which the different operation and correction modes are selectively controlled by means of a crown capable of being rotated in both directions.

The use of a crown has become very widespread at the present time, not only for esthetic reasons, but also for enabling the wearer to facilitate different operations, such as those for standard mechanical watches, such as setting the hour, day or month.

However, the degree of freedom of movement of the crown is limited to two directions of rotation and to two or, at most, to three axial positions of the stem. It is important to optimize the crown control apparatus, so that a growing number of operation and correction modes can be attained, simply if possible, by manipulating the crown. This growing number of modes results in turn from the expanding complexity of the circuits with which electronic watches are equipped to day.

That is why one of the objects of the invention is to offer a correction device in which two different types of corrections of the data displayed can be made in the same axial position of the crown, the direction of the corrections being determined by the direction of rotation of the crown.

In one particularly advantageous embodiment of the invention, this device can be used to make:

1. the time zone change by 1-hour steps forward or back, and
2. or the time zone change by ½-hour steps forward or back.

There are, in fact, regions of the world where passage from one time zone to the neighboring zone is made in ½-hour steps. The value of providing for a rapid correction of indication of time not only by 1-hour steps, but also by ½-hour steps, is justified. This additional versatility preferably should not be accompanied by over complicating the control means or in the handling of this mechanism. This invention enables these two types of corrections to be made by using the same manipulations of the crown, to which is earmarked a single axial position corresponding to change of time zone.

For this purpose, one of the essential characteristics of the invention is to provide, in the correction device, means for detecting any reversal of direction of rotation of the crown after making a first type of correction, and for then controlling, in response to that detection, the stop of that first type of correction and use of a second type of correction.

The invention will be clearly understood by reading the following specification of one of its particular embodiments, given in connection with the attached FIGURE, which represents by means of a block diagram the operation of a correction device making possible the change of time zone in 1-hour or ½-hour steps.

On the FIGURE reference 60 represents the time base of an electronic watch, the pulses of which feed control circuit 61 of step motor 62, which drives an analogue watch display not represented.

The time zone corrections are made by means of a crown associated with a contact mechanism 1, 2, so that contact 1 is periodically closed on clockwise rotation of the crown and contact 2 is periodically closed when the crown is rotated in the opposite direction. Such a mechanism is by itself known and described, for example, in French Patent Application No. 77 06198.

Each pulse corresponding to the closing of contact 1 is used, as will be seen below, to trigger a forward circuit 41 by 1-hour steps, as well as a forward circuit 51 by only ½-hour steps. These forward circuits 41 and 51, as well as back circuits 42 and 52 are represented by different blocks which are connected to control circuit 61 of motor 62. Such circuits 41, 42, 51 and 52 also may form an integral part of that control circuit. Their function is to influence the means of control of motor 62, so as to make the latter perform a given number of rapid steps forward or back, corresponding to 1-hour or ½-hour time correction to be displayed.

In the same way as for contact 1, the pulses closing contact 2 selectively trigger back circuits 42 or 52, according to the type of correction desired. A contact 3 or any other means is operated on connection of the correction means, as for instance, by pulling the stem of the watch crown in order to move the crown to an axial position reserved for time zone changes.

A description will be given of one particular embodiment of the means used to detect any change in direction of rotation of the crown, on a correction by 1-hour steps, and to control, in response to that detection, the disconnection of forward or back circuits 41 or 42 and the use of forward or back circuits 51 or 52 to pass from a first correction mode (time zone change by 1-hour steps) to a second (time zone changes by ½-hour steps).

In order to detect whether the closing of one of the contacts occurs after a reversal of direction of rotation of the crown, it is checked whether, at the time of that closing, the crown has already been worked in the opposite direction, that is, whether at that time the other contact has already been closed at least once. For this purpose, a memory unit is provided to sense the contact state following closing of each contact.

It is then sufficient to provide a circuit which controls, at the time of a pulse on contact 1 or 2:

1. either forward circuit 41 or back circuit 42 (1-hour steps);
2. or forward circuit 51 or back circuit 52 (½-hour steps), according to whether, at the time of the pulse on that contact, the unit associated with the other contact indicates whether it had been previously manipulated.

Such a circuit includes, for example, a bistable trigger circuit 11, 12, capable of being brought into top position by the closing of contact 1,2.

The 1-hour step forward circuit 41 and back circuit 42 are controlled by means of an AND gate 21,22, each of which has two inputs, one of which is directly connected to contact 1,2, and the other, by means of a reversing circuit, to the output of bistable trigger circuit 12, 11. As a result, the forward or back circuits 41 or 42 will be controlled by their respective contact 1 or 2 only if the other contact has not yet been worked (rotation direction reversal step).

The ½-hour step forward circuit 51 and back circuit 52 are controlled an AND gate 31, 32, each of which has two inputs, one of which is directly connected to contact 1,2, and the other to the output of bistable trigger circuit 12, 11. As a result, forward or back circuits 51 or 52 may be controlled by their respective contact 1 or 2 only if the other contact has already been worked (reversal of direction of rotation).

In this particular case, one cannot go from the second correction mode to the first again, except by putting the crown back in its neutral position, and by pulling it again so as to operate contact 3 connected to the reset inputs of trigger circuits 11 and 12. This arrangement is simpler for the user when it is a question of passing from one time zone change mode to another, for he can then effectively first choose the direction of rotation by 1-hour steps and then the one by ½-hour steps. If a new reversal of the direction of correction by ½-hour steps entailed return to the mode of correction by 1-hour steps, it would never be possible to correct the zones by ½-hour steps in a given direction, if at the outset a correction by 1-hour steps had not been made in the opposite direction.

Although it has been described in connection with one particular embodiment, this invention lends itself to numerous variations and modifications, which would be apparent to those skilled in the art.

For example, in the device described, the time zone changes are obtained in the pulled position of the crown, but they could just as well be made in the neutral position of the crown, after operation of a second control unit (push button, capacitive key, file, etc.). It would then be sufficient to arrange for the operation of that second control unit to produce a reset of the bistable trigger circuits simultaneously.

What is claimed is:

1. A device for correction of data displayed by an electronic watch by means of a crown capable of being rotated in both directions, said device comprising first means of correction for making a first type of correction of the data displayed, the direction of the correction being determined by the direction of rotation of the crown, further comprising, second means of correction for making, in the same position of the crown, a second type of correction of the data displayed; and means for detecting a reversal of direction of rotation of the crown after a correction of said first type, and for controlling, in response to that detection, the disconnection of the first means of correction and the connection of the second.

2. A correction device according to claim 1, wherein the direction of the corrections made by said second means of correction is also determined by the direction of rotation of the crown.

3. A correction device according to claim 2, wherein the data being corrected is time data and the first means of correction enables rapid correction of said time data by 1-hour steps in the forward or backward directions, and said second means of correction enables the rapid correction of said time data by ½-hour steps in the forward or backward directions.

4. A correction device according to claims 1, 2 or 3, further comprising a memory means associated with each direction of rotation of the crown, said memory means comprising a first memory means being set to one state when the crown is rotated in a first direction and a second memory means set to one state when the crown is rotated in the opposite direction, and means for transmitting the order corresponding to rotation of the crown in a given direction to the first correction means if, at that instant, the memory means associated with the opposite direction of rotation is not in said one state, and to the second correction means if, at that instant, the memory means associated with the opposite direction of rotation is in said one state.

5. A device according to claim 4, characterized in that said memory means are reset when said first correction means is enabled to operate.

* * * * *